United States Patent [19]

Lüthi et al.

[11] 3,938,807

[45] Feb. 17, 1976

[54] BALL GAME WITH SHIFTABLE LABYRINTHINE PLATFORM

[76] Inventors: Hanspeter Lüthi, Maurstrasse 58, CH-8117 Fallanden; Werner Dubach, Illnauerstrasse 32, CH-8307 Effretikon, both of Switzerland

[22] Filed: Dec. 27, 1974

[21] Appl. No.: 536,763

[30] Foreign Application Priority Data

Jan. 4, 1974 Switzerland ..... 54/74

[52] U.S. Cl. ..... 273/110; 273/115

[51] Int. Cl.[2] ..... A63F 7/16

[58] Field of Search ..... 273/109, 110, 112, 113, 273/115, 116, 120 R, 153 R

[56] References Cited

UNITED STATES PATENTS

| | | | |
|---|---|---|---|
| 569,194 | 10/1896 | Giles | 273/115 |
| 1,291,105 | 1/1919 | Parker | 273/110 |
| 1,314,898 | 9/1919 | Peck | 273/113 |
| 2,011,266 | 8/1935 | Boynton | 273/153 R |
| 2,791,428 | 5/1957 | McDonald | 273/110 |

*Primary Examiner*—Anton O. Oechsle
*Assistant Examiner*—Harry G. Strappello
*Attorney, Agent, or Firm*—Pollock, Vande Sande & Priddy

[57] ABSTRACT

A ball game has a housing with a transparent cover, and a labyrinthine platform disposed in the housing. A plurality of balls are positioned between the platform and the transparent cover. The labyrinthine platform is resiliently loaded in the direction towards the transparent cover, and thus tends to trap the balls between the platform and the cover. One or more actuating handles are provided to project externally of the housing for shifting the labyrinthine platform against the action of its loading, thereby to free the balls, thus giving the user a possibility of controlling the running of the balls on the labyrinthine platform.

10 Claims, 12 Drawing Figures

BALL GAME WITH SHIFTABLE LABYRINTHINE PLATFORM

Figure 1:
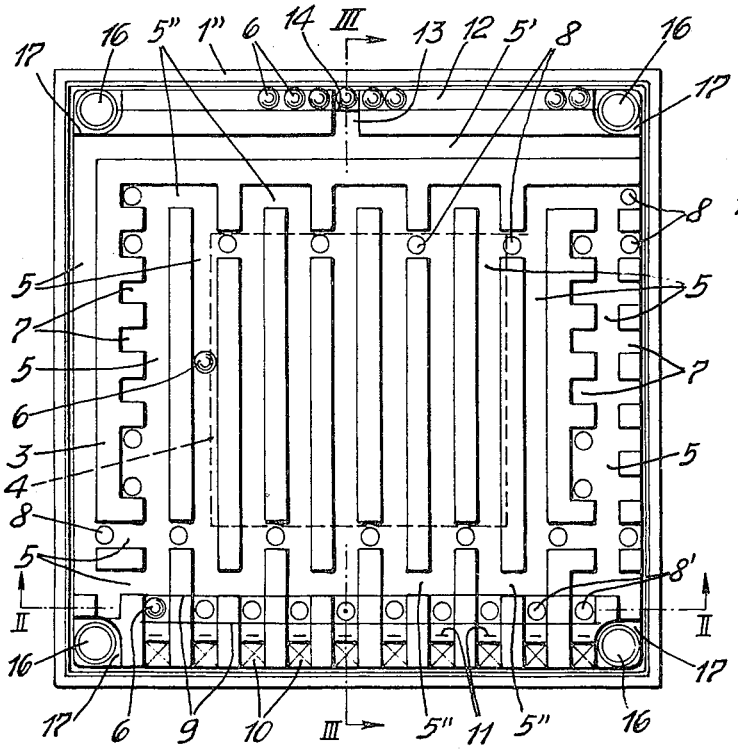

Ball games of skill are known which have a platform, movable in all directions, which forms the playing area and is provided with channels, transverse passages and openings through which the balls can drop. The object is to guide the balls along the channels and transverse passages towards a given goal by altering the angle of tilt of the playing area or of the platform. In so doing, the balls can move freely and are thus to some extent uncontrollable, with the result that chance triumphs over skill, thereby detracting from the pleasure derived from the game.

The subject of the present invention differs from these familiar ball games of skill in that, in the area in which the balls can move, means are provided for arbitrarily slowing down the balls or bringing them to a halt.

Figure 3:
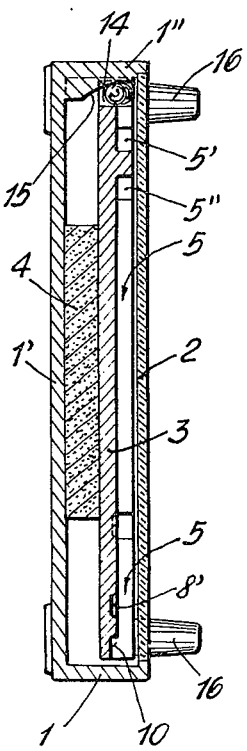
Figure 2:
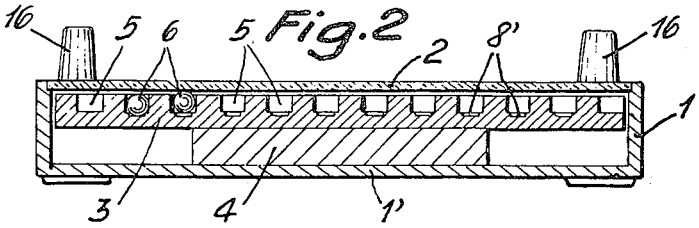
Figure 4:
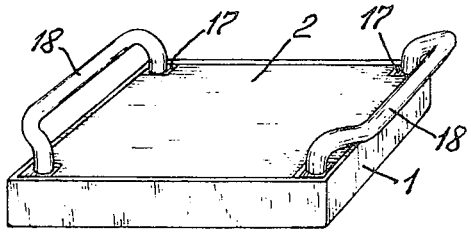
Figure 5:
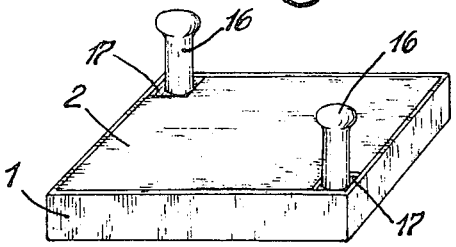
Figure 6:
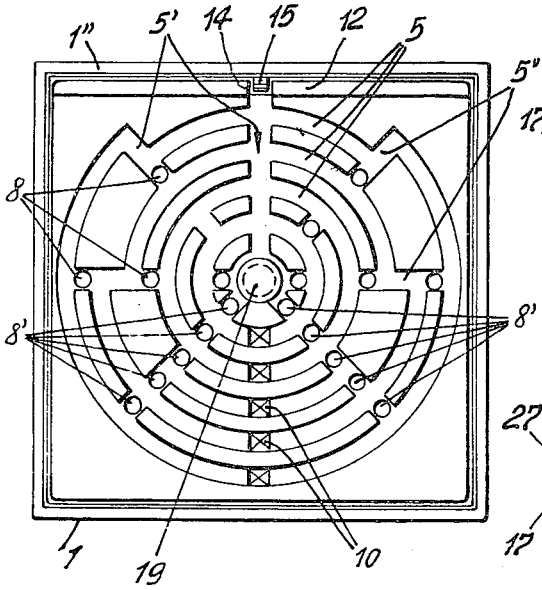
Figure 9:
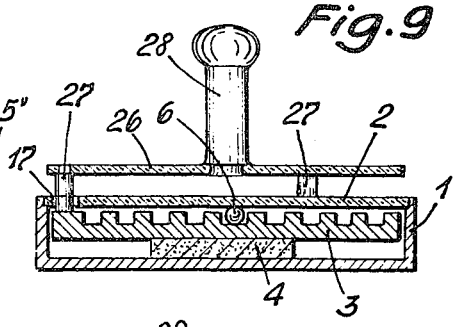
Figure 10:
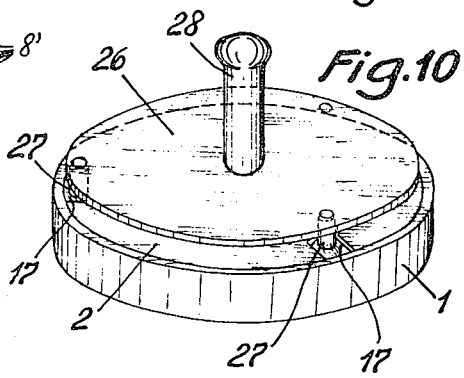
Figure 7:
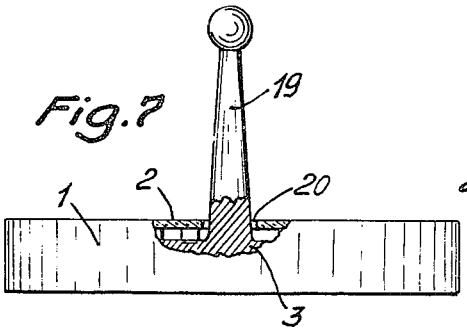
Figure 11:
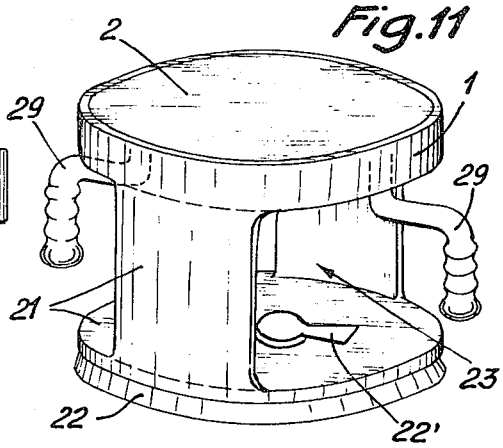
Figure 8:
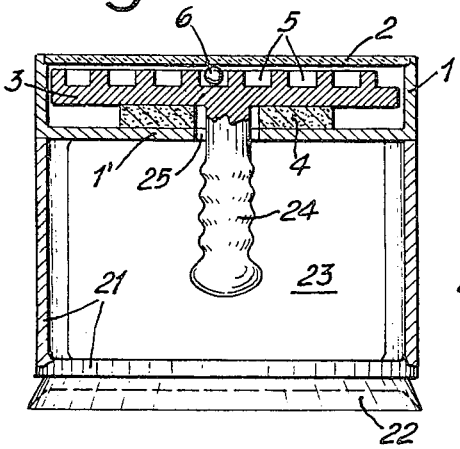
Figure 12:
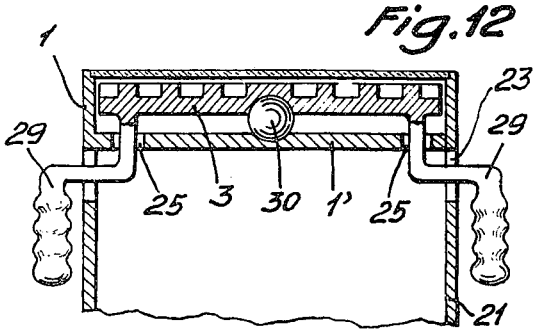

The drawing shows, as examples, various versions of the subject of the invention, as follows:

FIG. 1 a view from above of a first version,
FIG. 2 a section through the line II-II in FIG. 1,
FIG. 3 a section through the line III-III in FIG. 1,
FIG. 4 a diagrammatic representation of a second version,
FIG. 5 a third version in diagrammatic form,
FIG. 6 a view from above of a fourth version,
FIG. 7 a sketch relating to FIG. 6, partly in section,
FIG. 8 a vertical section through a fifth version,
FIG. 9 a vertical section through a sixth version,
FIG. 10 the same version in diagrammatic form,
FIG. 11 a seventh version in diagrammatic form,
FIG. 12 an eighth version, partly in section.

In FIGS. 1 to 3, 1 indicates a flat plastic housing, the detachable cover 2 of which is preferably made of transparent plastic such as plexiglass and which is secured by a spring catch. 3 is a labyrinthine platform of plastic, wood or metal which can be moved vertically in the housing and which is pressed against the cover 2 by a spring element 4 made of foam or Sorbo rubber, located on the base 1′ of the housing. Any suitable steel spring can also be used to achieve this spring effect. The playing area of the movable labyrinthine platform 3 has, at the top, open longitudinal and transverse channels 5 and 5′ for the steel balls 6. The longitudinal and transverse channels 5 are connected to one another by transverse passages 5″. 7 are recesses let into the sidewalls of the channels 5, on one or both sides, which act as obstacles to the passage of the balls along the channels 5. Indentations 8 for trapping the balls, consisting, with a few exceptions, of shallow hollows formed in the channels, are provided in the transverse passages 5″ of the longitudinal channels 5, to hinder rolling of the balls. Similar indentations 8 are provided in some of the channel recesses 7. 8′ are flat indented hollows arranged in rows near the ends of the longitudinal channels 5 on a raised section running at right angles thereto and marked on the cover 2 by a red boundary line 9, numerals on the cover 2 indicating the points scored. Behind the raised section 9, the channels are provided with very deep indentations 10, each of which has a coloured minus sign 11 above it on the cover 2. Opposite the very deep indentations 10, the labyrinthine platform 3 has an equally deeply indented transverse channel 12 for storage of the balls, which is linked to the transverse passage 5′ by a longitudinal passage 13. The storage channel 12 is interrupted in the middle by a marginal recess 14 in the labyrinthine platform 3. A wedge 15 for bringing the balls into play engages in this marginal recess 14 and is located inside the housing wall 1″. Projecting above all four corners of the labyrinthine platform 3 are operating buttons 16, which pass through the cover 2 in openings 17 in the corners.

Because the diameter of a ball 6 is greater than the dept of a channel 5, 5′ and of a passage 5″, release of the buttons 16 means that any ball 6 in the playing area is clamped and slowed down between the labyrinthine platform 3 and the cover 2, so that it is held stationary. If, however, as a result of pressing the appropriate buttons 16, the labyrinthine platform 3 is brought into a tilted position which causes the balls to roll in the desired direction, then the griping pressure on the balls is released and they can roll. Releasing the buttons 16 results in momentary braking and stoppage of the balls. If all the balls are in the storage space 12, the depth of which is greater than the diameter of a ball 6, then, if all the buttons 16 are released, the result is that sufficient space is left between the labyrinthine platform 3 and the cover to prevent braking or clamping of the balls.

When the ball game is being played, it should rest on a horizontal support such as a table top. To start the game, all ten balls should be brought into the storage space 12. This is done by depressing all the buttons 16 simultaneously and placing the housing 1 on the sidewall 1″. When all the balls 6 have been rolled in this manner into the storage space 12, one person can start the game by placing two fingers of each hand on each of two opposite buttons. By pressing one or two of the buttons 16, the labyrinthine platform 3 can be made to tilt in any desired direction and the ball which has been brought into play made to roll in accordance with the inclination of the labyrinthine platform 3.

A ball 6 is shot into the playing area by conveying one of the balls in the storage area 12 into the marginal recess 14 by appropriate tilting of the labyrinthine platform 3. It is now possible to shoot the ball via the longitudinal passage 13 into the playing area by simultaneously depressing all four buttons 16, and using the wedge 15 (FIG. 3) which projects into the marginal recess 14. The ball 6, which first enters the transverse passage 5′, can now, by appropriate tilting of the labyrinthine platform 3, be made to roll into the outermost longitudinal channel 5 on the left and then, by alternately depressing the appropriate buttons 16, made to roll through the longitudinal channels 5 and those transverse passages 5″ which do not have a hollow 8 to trap the ball. If, however, a ball rolls into a trap 8, it is regarded as out of play, as it is impossible to retrieve it therefrom solely by means of the permissible operation of the buttons. Another ball 6 must therefore be shot into the playing area. If a ball is successfully rolled into a winning hole 8′, then this ball scores the number of points allotted to this hole 8′. If, however the ball rolls over the hole 8′ into the deep identation 10, this counts as a double penalty which is to be deducted from the final score.

Several persons may take part, one after another, in the ball game described, trying to get the ten balls into the winning holes 8′. The winner is the person who, in the final score, has the most points.

The same operating method and form of play apply to the versions of the ball game described below.

In accordance with FIG. 4, two handles 18 are provided for operating the labyrinthine platform 3, the ends of which pass through handle holes 17 in the cover 2 and are secured to the corners of the labyrinthine platform 3.

In accordance with FIG. 5, two elongated buttons or controls 16, which pass through corner holes in the cover 2, are secured to two diagonally opposite corners of the labyrinthine platform 3.

In FIGS. 6 and 7, the labyrinthine platform 3 is fitted with an operating lever 19 secured at its centre, which protrudes upwards through a hole 20 in the cover 2. In this case, the channels 5 are arranged in concentric circles in relation to one another, and are linked to one another by radial passages 5'', indentations 8 being inserted as additional hazards in the majority of the passages 5''. 8' indicates the winning holes, which are arranged in radial passages in two radial rows. 10 represents deeper holes, and balls falling into them count as double penalties. By pressing down the lever 19 and placing the housing 1 on to the sidewall 1'', all the balls in the playing area are simultaneously fed to the storage area 12. In addition, pressing down the operating lever 19 when the playing area is horizontal causes one ball to be ejected each time from the storage area.

In FIG. 8, the housing 1 is fitted with a hollow base 21 with a suction cup 22 on its underside, making it possible to secure the game to a smooth table top. The base 21 has two large recesses 23 located opposite one another, giving free access by hand to an operating lever or control 24 extending vertically downwards inside the hollow base. This lever is located centrally on the underside of the labyrinthine platform 3 and passes through a central opening 25 in the bottom of the housing 1'. A ring-shaped foam cushion 4 presses the labyrinthine platform 3 against the cover 2 and, when the control 24 is not under pressure, causes any balls 6 which may be in the playing area to be blocked (FIG. 8). Pulling the control 24 downwards releases the ball 6, which can then roll into the channels 5, depending on the angle of tilt of the labyrinthine platform 3. Appropriate movement of the control 24 tilts the labyrinthine platform 3 in all directions.

As shown in FIGS. 9 and 10, the housing is round. A transparent securing plate 26 fitted a short distance above the transparent cover 2 is connected to the platform 3 by means of three pins 27 passing through the former in marginal recesses 17. Fixed to the centre of the securing plate 26 is an operating lever 28, manipulation of which causes the angle of tilt of the labyrinthine platform 3 to be changed in all directions. Pressing the control 28 downwards lowers the labyrinthine platform 3 against the action of the foam cushion 4 and releases the balls in the playing area, while removal of pressure on the control 28 locks the balls 6 present in the playing area.

The round housing shown in FIG. 11 is supported by the hollow base 21, and the latter with a suction cup 22 operated by a lever 22'. Easily accessible in two opposite recesses 23 are two operating levers 29 which, as in FIG. 8, pass, with some play, through openings 25 in the base 1' of the housing and are connected to the labyrinthine platform 3.

As shown in FIG. 12, the labyrinthine platform 3 is supported on a centrally located spring-loaded ball 30 against the base 1' of the housing. The ball, which can be solid or hollow, engages in suitable cavities in the base 1' of the housing. Instead of this ball 30, it would also be possible to have a coil spring standing vertically on the base 1' of the housing.

The labyrinthine platform 3 can have channels 5, 5' and passages 5'' in various shapes, as may be seen from FIGS. 1 and 6, by means of which the degree of difficulty of the game is determined. The labyrinthine platform 3 is interchangeable, and can easily be replaced by a platform of a different degree of difficulty.

Because of the possibility of slowing down and stopping the balls at selected points on the labyrinthine platform, the players are to a large extent dependent on their skill, and chance, which detracts from the fun of the game, does not have any decisive effect on the course of the game.

We claim:

1. A ball game comprising a housing having a transparent cover, a labyrinthine platform in said housing, a plurality of balls disposed between the cover and the labyrinthine platform, loading means for urging the labyrinthine platform resiliently towards the cover whereby the cover and the platform may engage the opposite diametrical portions of at least one of said balls, and actuating means connected to the labyrinthine platform and accessible externally of said housing for manual shifting of said labyinthine platform against the action of its loading means and thereby releasing said at least one engaged ball.

2. A ball game as claimed in claim 1, wherein said housing comprises a transverse passage for storage of said balls, and wherein there is provided in said housing a projecting device for projecting balls into play from said storage passage, said projecting device being positioned for operation by said labyrinthine platform when said platform is shifted manually against the action of its loading means.

3. A ball game, as claimed in claim 1, wherein said labyrinthine platform includes transverse passages and lateral recesses therefor, and wherein indentations are provided in said passages and recesses for trapping said balls.

4. A ball game, as claimed in claim 1, wherein said loading means comprises a resilient cushion disposed between said housing and said labyrinthine platform.

5. A ball game, as claimed in claim 1, wherein said actuating means comprise buttons which project with clearance through openings in said transparent cover.

6. A ball game, as claimed in claim 1, wherein said actuating means comprise elongated handles each having two legs which pass with clearance through marginal openings of said transparent cover.

7. A ball game, as claimed in claim 1, wherein said actuating means comprise a handle positioned centrally on said labyrinthine platform and extending with clearance through an opening in said cover.

8. A ball game, as claimed in claim 1, wherein said housing is supported on an apertured hollow foot, and wherein said actuating means comprise a handle positioned centrally on said labyrinthine platform and projecting through an opening in said housing into said hollow foot.

9. A ball game, as claimed in claim 1, wherein said actuating means comprises a securing plate carrying a centrally mounted handle, said securing plate being spaced from said transparent cover at the side of said cover remote from said labyrinthine platform, said securing plate being coupled to said labyrinthine platform by a plurality of pins passing with clearance through marginal openings of said transparent cover.

10. A ball game, as claimed in claim 1, wherein said housing is supported on an apertured hollow foot, and wherein said loading means is a ball disposed centrally between said housing and said labyrinthine platform, and wherein said actuating means comprises two handles disposed at diagonally opposite points of said labyrinthine platform and passing with clearance through openings in said housing and projecting through the aperturing of said foot to the exterior thereof.

* * * * *